US011005150B2

(12) United States Patent
Voineau et al.

(10) Patent No.: US 11,005,150 B2
(45) Date of Patent: May 11, 2021

(54) ASSEMBLY FOR THE PROPAGATION OF WAVES IN THE FREQUENCY RANGE BETWEEN 1 GHZ AND 10 THZ

(71) Applicants: UNIVERSITE DE BORDEAUX, Bordeaux (FR); INSTITUT POLYTECHNIQUE DE BORDEAUX, Talence (FR); CENTRE NATIONAL DE LA RECHERCHE SCIENTIFIQUE—CNRS, Paris (FR)

(72) Inventors: Florian Voineau, Niort (FR); Anthony Ghiotto, Talence (FR); Eric Kerherve, Pessac (FR)

(73) Assignees: UNIVERSITE DE BORDEAUX, Bordeaux (FR); INSTITUT POLYTECHNIQUE DE BORDEAUX, Talence (FR); CENTRE NATIONAL DE LA RECHERCHE SCIENTIFIQUE—CNRS, Paris (FR)

( * ) Notice: Subject to any disclaimer, the term of this patent is extended or adjusted under 35 U.S.C. 154(b) by 263 days.

(21) Appl. No.: 16/097,735

(22) PCT Filed: May 2, 2017

(86) PCT No.: PCT/FR2017/051050
§ 371 (c)(1),
(2) Date: Oct. 30, 2018

(87) PCT Pub. No.: WO2017/191409
PCT Pub. Date: Nov. 9, 2017

(65) Prior Publication Data

US 2020/0395648 A1 Dec. 17, 2020

(30) Foreign Application Priority Data

May 3, 2016 (FR) ..... 16 54003

(51) Int. Cl.
*H01P 3/16* (2006.01)
*H01P 3/12* (2006.01)

(52) U.S. Cl.
CPC . *H01P 3/16* (2013.01); *H01P 3/12* (2013.01)

(58) Field of Classification Search
CPC ..... H01P 3/12; H01P 3/16
See application file for complete search history.

(56) References Cited

U.S. PATENT DOCUMENTS 3,703,690 A 11/1972 Ravenscroft et al.
4,216,449 A 8/1980 Kach
(Continued)

FOREIGN PATENT DOCUMENTS

EP 2 958 187 12/2015

OTHER PUBLICATIONS

International Search Report, PCT/FR2017/051050, dated Aug. 30, 2017.

(Continued)

*Primary Examiner* — Samuel S Outten
(74) *Attorney, Agent, or Firm* — Nixon & Vanderhye

(57) ABSTRACT

Disclosed is an assembly for the propagation of waves of frequencies between 1 GHz and 10 THz, including: (a) a waveguide to guide the waves, the waveguide being produced from a plastic material, a part of the waves propagating inside this waveguide and another part of the waves propagating outside this waveguide; and (b) a protective covering which surrounds the waveguide delimiting one or more spaces between the waveguide and the covering, in which space or spaces the waves propagating outside the waveguide are contained, the protective covering thus forming a barrier to protect these waves from external disturbances.

18 Claims, 4 Drawing Sheets

(56) References Cited

U.S. PATENT DOCUMENTS

| | | | | |
|---|---|---|---|---|
| 2007/0063914 | A1* | 3/2007 | Becker | H01Q 1/44 343/840 |
| 2010/0001809 | A1* | 1/2010 | Yanagisawa | H01P 5/103 333/26 |
| 2010/0135626 | A1* | 6/2010 | Sun | H01P 3/16 385/123 |

OTHER PUBLICATIONS

Devore R et al: "Dielectric coaxial waveguide", Journal of Appli Ed Physics, vol. 44, No. 10, Oct. 1, 1973 (Oct. 1, 1973), pp. 4488-4500, XP001369420, p. 4488-p. 4494; figures 1,19.

Devore R: "Coaxial dielectric waveguides. I I", Journal of Applied Physics vol. 45, No. 7, Jul. 1, 1974 (Jul. 1, 1974), pp. 2874-2880, XP001369419, abstract.

* cited by examiner

ASSEMBLY FOR THE PROPAGATION OF WAVES IN THE FREQUENCY RANGE BETWEEN 1 GHZ AND 10 THZ

BACKGROUND OF THE INVENTION

Field of the Invention

The present invention relates to the field of plastic waveguides for the propagation of waves of frequencies between 1 GHz and 10 THz, and more particularly relates to an improved assembly for the propagation of waves including such a plastic waveguide.

It relates also to a wired or wireless communication link for the transmission of signals at high speed, which includes such an assembly.

Technological Background

Waves having frequencies between 1 GHz and 10 THz are non-ionizing radiation which can penetrate a wide range of non-conducting materials such as wood, plastic, ceramics and paper.

Also, these waves offer new and extensive opportunities in technical fields as varied as spectroscopy, physics, communications, imagery, the medical field and biology, to name just a few fields.

A vast amount of research has been carried out for several years to provide for the propagation of such waves since the waveguides available to guide electromagnetic waves in other frequency domains are not suitable. In particular, existing waveguides are not suitable for guiding terahertz waves, the frequencies of which are between 0.1 THz and 10 THz.

Waveguides made of plastic material have thus been produced for the propagation of terahertz waves.

Although forming a notable advancement over metal-based devices developed for guiding terahertz waves, which devices are complex and rigid, these waveguides made of plastic material exhibit drawbacks.

Specifically, it is observed that if a part of the waves propagates well within the plastic waveguide, another part of the terahertz waves propagates outside it.

These plastic waveguides for the propagation of terahertz waves of the prior art are, consequently, extremely sensitive to external contacts, which can bring about significant losses in intensity of the signal.

By way of illustration, it is hence not possible to have such plastic waveguides rest on a table, nor to handle them.

To address these drawbacks, an attempt has therefore been made to cover these plastic waveguides with a low-permittivity dielectric material or to place them in a foam.

Low-loss materials are also adopted so as not to increase losses through attenuations due to the propagation.

However, the result of this is an increased cost of manufacture of these plastic waveguides for the propagation of terahertz waves, which waveguides are also more complex to produce.

Furthermore, the use of foam is a source of risks for the mechanical stability and reliability of such terahertz wave guides.

The size of the terahertz waveguides thus protected also turns out to be increased.

A pressing need therefore exists for an assembly for the propagation of terahertz waves, and more generally for the propagation of waves in the frequency domain between 1 GHz and 10 THz, the original design of which addresses the drawbacks of the prior art recalled above.

Object of the Invention

The present invention relates to an assembly for the propagation of waves of frequencies between 1 GHz and 10 THz, that is simple in its design and in its mode of operation, reliable and economic while enabling a high-speed data transfer.

Another subject of the present invention is a wired or wireless communication link including such an assembly for the propagation of waves of frequencies between 1 GHz and 10 THz, said link not being very expensive and providing a wide bandwidth and a high degree of mechanical reliability.

Yet another subject of the present invention is a device for receiving/transmitting electromagnetic waves in the band of frequencies between 1 GHz and 10 THz including such an assembly for the propagation of waves.

BRIEF DESCRIPTION OF THE INVENTION

To this end, the invention relates to an assembly for the propagation of waves of frequencies between 1 GHz and 10 THz.

According to the invention, this assembly comprises:

(a) a waveguide to guide said waves, this waveguide being produced from a plastic material, a part of said waves propagating inside this waveguide and another part of said waves propagating outside this waveguide, and (b) a protective covering which surrounds the waveguide delimiting one or more spaces between this waveguide and this covering, in which space or spaces the waves propagating outside this waveguide are contained, said protective covering thus forming a barrier to protect these waves from external disturbances. Advantageously, it is thus observed that this protective covering genuinely isolates from the exterior the waves propagating inside the waveguide and outside the waveguide, and consequently provides for minimizing the impact of external disturbances on the waves. By forming a barrier, this protective covering also prevents access to the space or spaces in which the waves propagating outside the waveguide develop. It is therefore possible to have one or more areas of contact of the assembly with the exterior without a significant loss in signal intensity.

Preferably, this protective covering, or sheath, is arranged concentrically with this waveguide.

In various particular embodiments of this assembly for the propagation of waves, each having its particular advantages and open to numerous possible technical combinations:

said space is filled, or said spaces are filled, with a gaseous fluid such as air.

Alternatively, this space or these spaces are vacuums.

Alternatively again, this space or these spaces can be filled with a dielectric material having a permittivity lower than the permittivity of said waveguide.

Purely by way of illustration, the dielectric material having a permittivity lower than the permittivity of said waveguide is a foam.

this protective covering being an elongated tubular element, at least the thickness W of said tubular element is determined so as to minimize the influence of said protective covering on the modes of propagation.

Preferably, this protective covering is thus configured not only to facilitate the production of the assembly for the propagation of waves, but also to prevent it from disrupting the modes of propagation of waves inside the waveguide.

By way of example, this elongated tubular component can exhibit a square, rectangular, elliptical etc cross-section.

this protective covering exhibits a circular or substantially circular transverse cross-section.

Advantageously, such a configuration of the protective covering provides for limiting contacts of the assembly with a flat surface and, consequently, limits external disturbances.

Nevertheless, the shape of this transverse cross-section can also be chosen from the group comprising a square, rectangular, elliptical, etc shape.

More generally, the protective covering could exhibit a surface relief contributing toward the removal of external disturbances. For example, the periphery of the protective covering could exhibit ribs or protrusions.

said waveguide exhibits a square, rectangular or cross-shaped transverse cross-section.

Said waveguide exhibiting a cross-shaped transverse cross-section, the latter can be solid or include one or more holes.

The implementation of a waveguide having a cross-shaped transverse cross-section provides for doubling the number of possible modes of propagation compared with a waveguide having a rectangular cross-section, while reducing interference, or crosstalk, phenomena to a minimum. This is achieved by virtue of the orthogonality of fields oscillating at the same frequency.

Such a configuration is particularly advantageous in the framework of full-duplex communication, i.e. a communication without interference.

It is also very useful for improving speed in unidirectional, half-duplex and full-duplex communication modes.

Advantageously, such a configuration provides for improving the compactness of a communication system integrating such a device in comparison with entirely multimode communication devices.

The presence of one or more holes has the effect of lightening the assembly and reducing losses. This or these holes can be filled with a dielectric material having a permittivity lower than the permittivity of said waveguide, which hence contributes to the rigidity of the assembly for the propagation of waves.

Purely by way of illustration, this dielectric material having a permittivity lower than the permittivity of said waveguide is a foam.

this protective covering being made of plastic, it is produced from the same plastic material as said waveguide.

Advantageously, the protective covering and the waveguide are produced from polytetrafluoroethylene (PTFE-Teflon®).

Generally, the protective covering and the waveguide are produced from at least one material chosen from the group comprising polyurethane (PU), polytetrafluoroethylene, polyethylene (PE), polypropylene (PP), polystyrene (PS), polycarbonate (PC), Mylar (PET), plexiglas (PMMA), polyvinyl (PVC), polychlorides, polyvinyls, Nylon (PA), acrylonitrile butadiene styrene (ABS), polylactic acid (PLA) and combinations of these elements.

Preferably, this assembly for the propagation of waves is a single piece. By not resulting from the assembling of initially separate components, this assembly advantageously exhibits increased mechanical strength and stability to ensure the guiding of waves in the band of frequencies between 1 GHz and 10 THz.

Advantageously, such an assembly can also be obtained by any conventional method for manufacturing plastic parts, such as extrusion or injection molding, and is therefore easy to manufacture. Its cost of manufacture is also not high.

Furthermore, as the waves propagating outside the waveguide are not transported by the protective covering, since the latter surrounds the space in which they propagate, no critical manufacturing tolerance is required to produce it.

Alternatively, this protective covering is produced from a material that is different from that forming said waveguide. It can also be produced from silicon, resin, ceramic or rubber, but not from a metallic material. This protective covering can be produced using only one material or a mix of materials.

said waveguide is a leaky waveguide including one or more irregularities to generate electromagnetic waves.

The nature and positioning of these irregularities are controlled. These irregularities can thus be periodic or aperiodic.

Preferably, said protective covering also includes one or more irregularities to generate electromagnetic waves.

Purely by way of example, such an irregularity can consist of a local modification of the cross-section of the protective covering.

Advantageously, the assembly for the propagation of waves can thus form an antenna oriented for wireless communications.

The present invention relates also to a communication link. According to the invention, this communication link includes an assembly for the propagation of waves as described previously.

Preferably, each end of said assembly is coupled to a link connector, so as to enable two items of equipment to be connected to said assembly.

This communication link intended to transmit signals can be wired or wireless.

For example, since this assembly for the propagation of waves includes a first and a second end, it is coupled at each of its ends to a link connector chosen from the group comprising a USB connector, an HDMI connector, a DisplayPort (DP) connector and a Thunderbolt connector. Alternatively, and again for example, this can also be a connector for connecting to on-board systems.

This link connector can be male or female in type.

In the case of a wireless communication link, the ends of the assembly for the propagation of waves can be coupled to wireless transmitter/receiver devices in order to transmit or receive wireless signals.

The present invention relates also to a device for receiving/transmitting electromagnetic waves in the band of frequencies between 1 GHz and 10 THz. According to the invention, this device includes an assembly for the propagation of waves as described previously.

BRIEF DESCRIPTION OF THE DRAWINGS

Other particular advantages, aims and features of the present invention will emerge from the following description given, with an explanatory aim and one which is not at all limiting, with reference to the accompanying drawings, in which.

DETAILED DESCRIPTION OF EMBODIMENTS OF THE INVENTION

First of all, it is noted that the drawings are not to scale.

Figure 1:
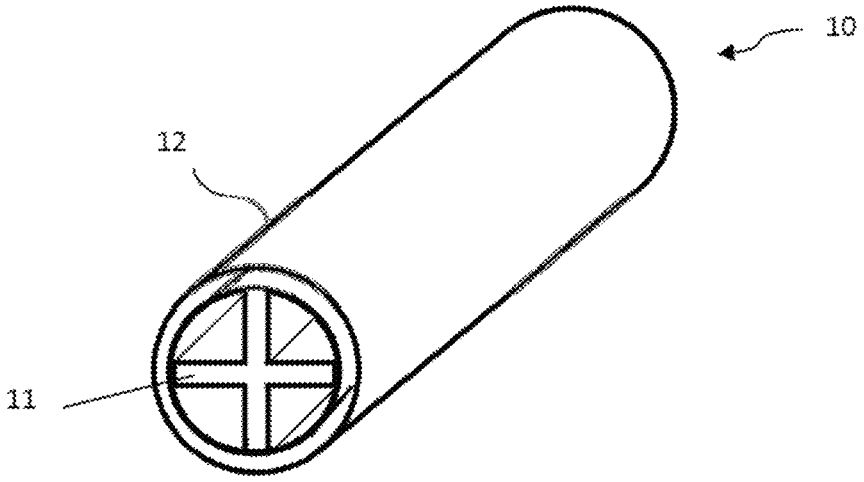
FIG. 1 schematically shows an assembly for the propagation of waves according to a first embodiment of the present invention.
Figure 2:
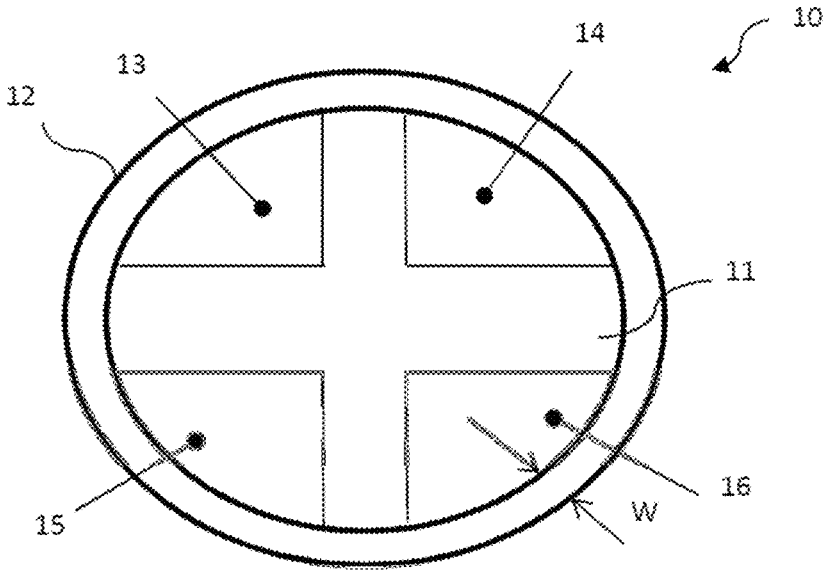
FIG. 2 is a transverse cross-sectional view of the assembly of FIG. 1.

FIGS. 1 and 2 schematically represent an assembly 10 for the propagation of waves according to a particular embodiment of the present invention;

This assembly 10 comprises a waveguide 11 to guide waves of frequencies between 1 GHz and 10 THz, which is produced from a plastic material such as polytetrafluoroethylene.

This waveguide 11 is in this case an elongated solid piece exhibiting a cross-shaped transverse cross-section, thereby advantageously providing for doubling the number of modes of propagation with respect to a waveguide having a rectangular cross-section. The axis of propagation of the waves is the longitudinal axis of this elongated solid piece.

This assembly 10 also includes a protective covering, or sheath, 12, which surrounds this plastic waveguide 11, delimiting several spaces 13-16. Each of these spaces 13-16 is in this case delimited on the one hand by the internal wall of the protective covering 12 and on the other hand by the outer surfaces of the waveguide 11 with a cross-shaped cross-section.

These spaces 13-16 are filled with a gaseous fluid, in this case air.

In a variant embodiment, these spaces could be filled by a material exhibiting a permittivity lower than that of the waveguide.

This protective covering 12 is in this case produced from the same plastic material as the plastic waveguide 11, the assembly 10 for the propagation of waves being of a single piece. This assembly is in this case obtained by an injection molding method.

A part of the waves propagates in this plastic waveguide 11 while another part of these waves propagates outside this waveguide 11 in the spaces 13-14 thus defined.

The waves propagating outside the plastic waveguide 11 are consequently contained in these spaces, being surrounded by the protective covering 12, which thus forms a barrier protecting these waves from external disturbances.

For a frequency of 80 GHz, this protective covering 12 exhibits in this case a thickness W in the order of 0.5 mm, which is sufficient to effectively protect against external stresses the waves propagating outside the waveguide 11.

Generally, this covering is defined so as to be on the one hand sufficiently thick to protect the waves propagating in the spaces and the waves propagating inside the waveguide from external disturbances, and on the other hand not too thick so as not to transform the covering itself into a propagation medium for the waves which would end up disrupting the operation of the waveguide.

The definition of this thickness results from a trade-off which depends strongly on the frequency of the waves and the material used.

Figure 3:
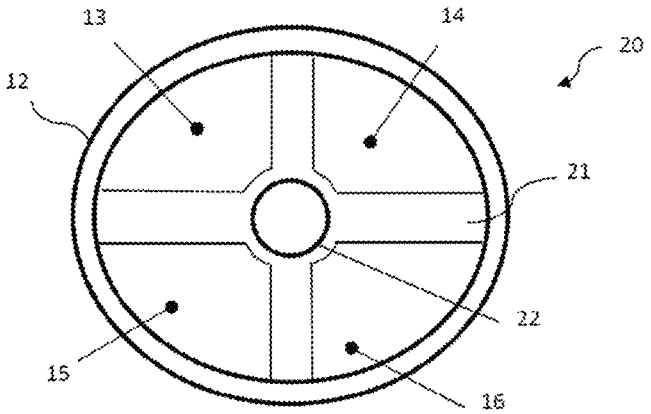
FIG. 3 is a transverse cross-sectional view of an assembly for the propagation of waves according to a second embodiment of the present invention.

FIG. 3 shows an assembly 20 for the propagation of waves according to a second embodiment of the present invention.

The elements of FIG. 3 bearing the same references as those of FIGS. 1 and 2 represent the same objects, which will not be described again hereafter.

This assembly 20 for the propagation of waves comprises a waveguide 21 to guide waves of frequencies between 1 GHz and 10 THz.

This waveguide 21 is in this case an elongated solid piece exhibiting a cross-shaped transverse cross-section with a central hole 22. This configuration advantageously provides for increasing the number of modes of propagation and minimizing losses.

Figure 4:
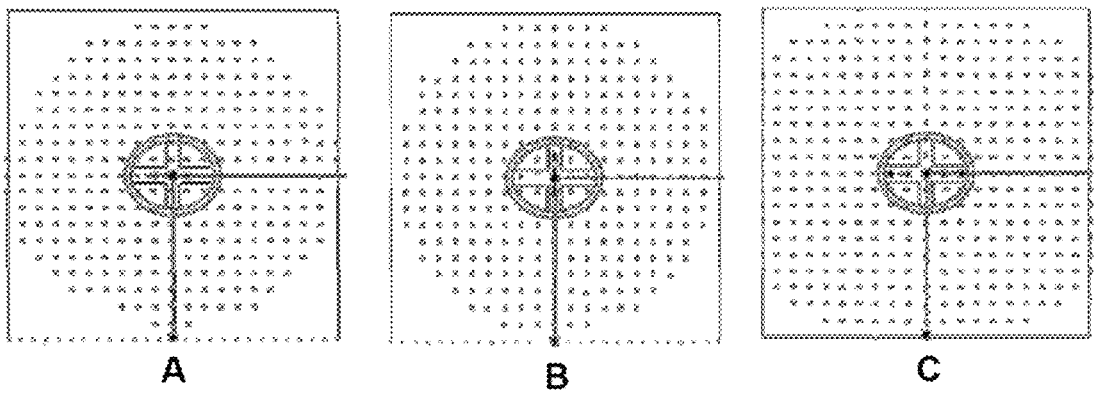
FIG. 4 schematically shows the field lines of the assembly of FIG. 1, in the absence of an external disturbance applied to this assembly for three modes of propagation, denoted by A (1st mode), B (2nd mode) and C (3rd mode), respectively, for a frequency of 80 GHz.

FIG. 4 shows the calculated spatial distribution of the electric field for the first three modes of propagation for a frequency of 80 GHz and for the assembly 10 for the propagation of waves described in FIGS. 1 and 2 in the absence of an external disturbance applied to the assembly.

Figure 5:
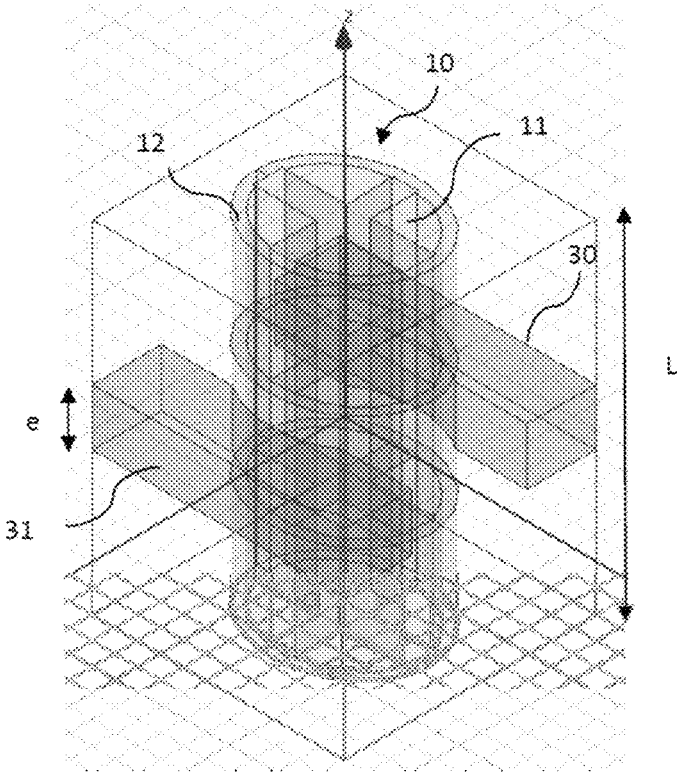
FIG. 5 illustrates a test of robustness of the assembly of FIG. 1 in which two blocks filled with an aqueous solution arrive at locally wrapping around the outer surface of the protective covering of this assembly to simulate the effect of manually gripping this assembly.

FIG. 5 illustrates a test of robustness of the assembly 10 for the propagation of waves of FIG. 1, in which two blocks 30, 31 filled with an aqueous solution arrive at locally wrapping around the outer surface of the protective covering 12 to simulate the effect of manually gripping this assembly.

The elements of FIG. 5 bearing the same references as those of FIGS. 1 and 2 represent the same objects, which will not be described again hereafter.

These dielectric blocks 30, 31 exhibit an electrical permittivity of eighty (80), which constitutes a major disturbance for the propagation of waves in said assembly 10 for the propagation of waves.

Figure 6:
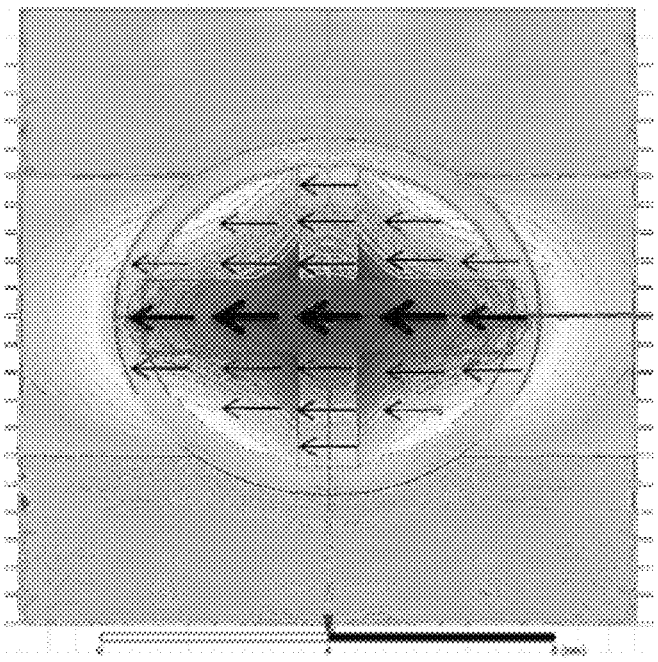
FIG. 6 shows the calculated spatial distribution of the electric field for the first mode of propagation for a frequency of 80 GHz, i.e. the first mode of propagation in the rectangular section placed along the axis of ordinates (y-axis) for the assembly of FIG. 5.
Figure 7:
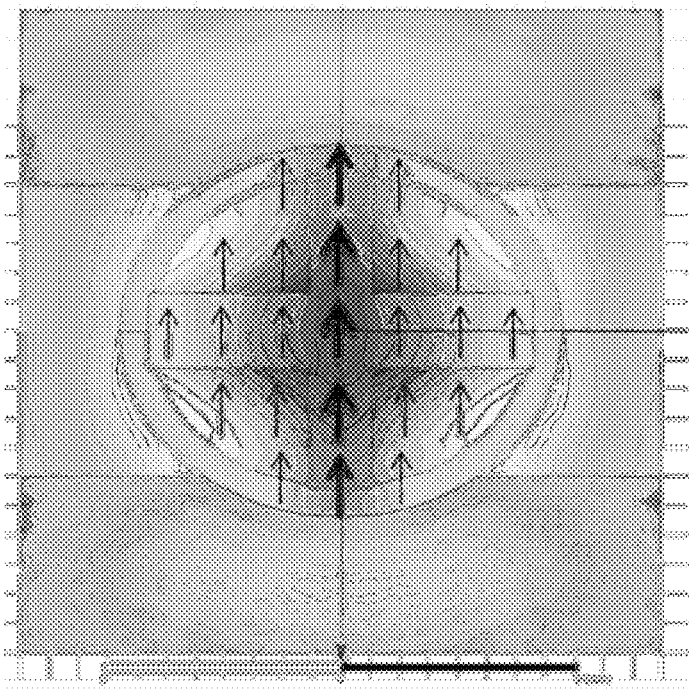
FIG. 7 shows the calculated spatial distribution of the electric field for the second mode of propagation for a frequency of 80 GHz, i.e. the first mode of propagation in the rectangular section placed along the axis of abscissae (x-axis) for the assembly of FIG. 5.
Figure 8:
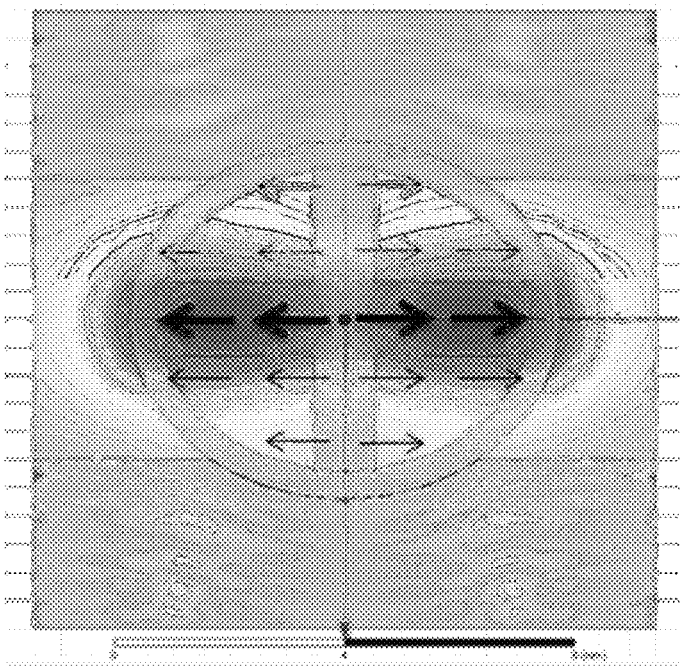
FIG. 8 shows the calculated spatial distribution of the electric field for the third mode of propagation for a frequency of 80 GHz, i.e. the second mode of propagation in the rectangular section placed along the axis of ordinates (y-axis) for the assembly of FIG. 5.

FIGS. 6 to 8 show the calculated spatial distribution of the electric field for the first three modes of propagation for a frequency of 80 GHz and for the assembly 10 for the propagation of waves described in FIGS. 1 and 2, when external contact is applied to this assembly via the two dielectric blocks 30, 31. These results have been obtained using simulation software from the company ANSYS Inc., Canonsburg, Pa. 15317, USA.

They clearly show the advantage brought by the assembly for the propagation of waves of the present invention. A comparison between the field lines generated in the assembly for the propagation of waves of FIG. 4 and the field lines generated in the assembly for the propagation of waves in the presence of an external disturbance, as represented in FIGS. 6 to 8, shows that the presence of the blocks 30, 31 does not modify the field lines in a significant manner.

The table below provides for illustrating in a quantitative manner the performance levels of the assembly for the propagation of waves of the invention.

The transmission of the signal is calculated on the one hand for an assembly including a waveguide having a cross-shaped cross-section, of FIG. 1, for the first two modes of propagation, and on the other hand for a waveguide having only a rectangular cross-section. This transmission is calculated in the presence of the blocks 30, 31 and in the absence of these blocks 30, 31. The assembly and the waveguide of rectangular cross-section exhibit a longitudinal dimension L in the order of 15 mm in the z-axis. The protective covering exhibits a thickness W of 0.5 mm.

TABLE

| | Transmission in the absence of blocks 30, 31 | Transmission in the presence of blocks 30, 31 | Additional losses | Dimension (e) of each block in the z-axis |
|---|---|---|---|---|
| Assembly with waveguide of cross-shaped cross-section [1st mode] | −0.09 dB | −0.25 dB | <0.2 dB | 2.5 mm |
| Assembly with waveguide of cross-shaped cross-section [2nd mode] | −0.09 dB | −0.25 dB | <0.2 dB | 2.5 mm |
| Waveguide with rectangular cross-section | −0.09 dB | −11.1 dB | 11 dB | 1.25 mm |

This table clearly shows the low signal losses obtained for the assembly for the propagation of waves of the invention, if the results obtained are compared with those of the waveguide which is not surrounded by a protective covering.

The losses due to the presence of the blocks 30, 31 are calculated as being only in the order of a few tens of decibels (dB).

The present invention thus provides for obtaining a strong and reliable assembly for the propagation of waves, at a particularly economical cost.

This assembly can be integrated in onboard electronic systems or in data processing centers to replace existing data transmission cables such as copper or optical fiber cables.

The invention claimed is:

1. An assembly for propagation of waves of frequencies between 1 GHz and 10 THz, comprising:

a waveguide (11, 21) to guide said waves, said waveguide (11, 21) being produced from a plastic material, a part of said waves propagating inside said waveguide (11, 21) and another part of said waves propagating outside said waveguide (11, 21); and a protective covering (12) which surrounds said waveguide (11, 21) delimiting one or more spaces between said waveguide (11, 21) and said covering in which the waves propagating outside said waveguide (11, 21) are contained, said protective covering (12) thus forming a barrier to protect the waves from external disturbances, wherein said protective covering (12) is made of a same plastic material as said waveguide (11, 21), and wherein the waveguide and the protective covering are formed as a single piece.

2. The assembly as claimed in claim 1, wherein said one or more spaces are filled with a gaseous fluid.

3. The assembly as claimed in claim 2, wherein, said protective covering (12) being an elongated tubular element, at least a thickness of said tubular element is determined so as to minimize an influence of said protective covering (12) on modes of propagation.

4. The assembly as claimed in claim 2, wherein said protective covering (12) exhibits a circular or substantially circular transverse cross-section.

5. The assembly as claimed in claim 2, wherein said waveguide (11, 21) exhibits a square, rectangular or cross-shaped transverse cross-section, which is solid or includes one or more holes.

6. The assembly as claimed in claim 1, wherein said one or more spaces are filled with a material having a permittivity lower than that of said waveguide (11, 21).

7. The assembly as claimed in claim 6, wherein, said protective covering (12) being an elongated tubular element, at least a thickness of said tubular element is determined so as to minimize an influence of said protective covering (12) on modes of propagation.

8. The assembly as claimed in claim 6, wherein said protective covering (12) exhibits a circular or substantially circular transverse cross-section.

9. The assembly as claimed in claim 6, wherein said waveguide (11, 21) exhibits a square, rectangular or cross-shaped transverse cross-section, which is solid or includes one or more holes.

10. The assembly as claimed in claim 1, wherein, said protective covering (12) being an elongated tubular element, at least a thickness of said tubular element is determined so as to minimize an influence of said protective covering (12) on modes of propagation.

11. The assembly as claimed in claim 10, wherein said protective covering (12) exhibits a circular or substantially circular transverse cross-section.

12. The assembly as claimed in claim 1, wherein said waveguide (11, 21) includes one or more irregularities to generate electromagnetic waves.

13. The assembly as claimed in claim 12, wherein said protective covering (12) includes one or more irregularities to generate electromagnetic waves.

14. The assembly as claimed in claim 1, wherein said protective covering (12) exhibits a circular or substantially circular transverse cross-section.

15. The assembly as claimed in claim 1, wherein said waveguide (11, 21) exhibits a square, rectangular or cross-shaped transverse cross-section, which is solid or includes one or more holes.

16. The assembly as claimed in claim 1, wherein said protective covering (12) and said waveguide (11, 21) are produced from at least one material chosen from the group comprising polyurethane (PU), polytetrafluoroethylene, polyethylene (PE), polypropylene (PP), polystyrene (PS), polycarbonate (PC), Mylar (PET), plexiglas (PMMA), polyvinyl (PVC), polychlorides, polyvinyls, Nylon (PA), acrylonitrile butadiene styrene (ABS), and polylactic acid (PLA).

17. A communication link, comprising an assembly for the propagation of waves as claimed in claim 1, each of the ends of said assembly being coupled to a link connector, so as to enable two items of equipment to be connected to said assembly.

18. A device for receiving/transmitting electromagnetic waves in the band of frequencies between 1 GHz and 10 THz, comprising an assembly for the propagation of waves as claimed in claim 1.

* * * * *